United States Patent [19]

Ziejewski et al.

[11] Patent Number: 4,823,756

[45] Date of Patent: Apr. 25, 1989

[54] NOZZLE SYSTEM FOR ENGINES

[75] Inventors: Mariusz Ziejewski; Hans J. Goettler, both of Fargo, N. Dak.

[73] Assignee: North Dakota State University of Agriculture and Applied Science, Fargo, N. Dak.

[21] Appl. No.: 172,402

[22] Filed: Mar. 24, 1988

[51] Int. Cl.[4] ..... F02M 67/02

[52] U.S. Cl. ..... 123/531; 123/1 A; 123/26; 123/251; 239/113; 239/404; 239/533.2

[58] Field of Search ..... 123/531, 533, 26, 1 A, 123/250, 251; 239/113, 404, 533.2

[56] References Cited

U.S. PATENT DOCUMENTS

| | | | |
|---|---|---|---|
| 923,054 | 5/1909 | Lietzenmayer | 123/533 |
| 1,066,755 | 7/1913 | Rorabeck | 123/533 |
| 1,117,738 | 11/1914 | Winton | 123/531 |
| 1,288,439 | 12/1918 | Pattinson | 123/533 |
| 1,466,085 | 8/1923 | Buschke | 123/532 |
| 1,871,115 | 8/1932 | Cowardin et al. | 123/533 |
| 1,943,495 | 1/1934 | Thomas | 123/261 |
| 2,127,165 | 8/1938 | Ehrat | 123/531 |
| 2,710,600 | 6/1955 | Nallinger | 123/533 |
| 2,720,870 | 10/1955 | Grob | 123/261 |
| 2,734,491 | 2/1956 | Hoffman | 123/261 |
| 4,149,497 | 4/1979 | Zeliszkewycz | 123/533 |
| 4,170,205 | 10/1979 | Fiedler | 123/447 |
| 4,210,105 | 7/1980 | Nohira et al. | 123/250 |
| 4,250,852 | 2/1981 | Kerimov et al. | 123/260 |
| 4,381,077 | 4/1983 | Tsumura et al. | 239/89 |
| 4,395,983 | 8/1983 | Hamai et al. | 123/263 |

*Primary Examiner*—Andrew M. Dolinar
*Attorney, Agent, or Firm*—Robert C. Baker

[57] ABSTRACT

A nozzle assembly having a premix chamber is provided for the injection of premixed fuel and air or other gas into a diesel engine cylinder. Air, or other gas, is supplied continuously to the premix chamber through a port connected to a high pressure reservoir. Fuel is delivered into the premix chamber through a typical poppet injection nozzle. The passage orientation into the premix chamber and the magnitude of the fuel and air pressure determine the mixing level. By pressure of the air, the compressed fuel-air mixture is injected, into the diesel engine cylinder. To remove fuel remaining in the injection cavity and injection orifices, an air injection follows the fuel-air mixture injection. After the air injection, the fuel for the next cycle is promptly injected into the premix chamber to allow about 700 crank angle degrees for premixing with air and vaporization in the operation of a four stroke engine.

15 Claims, 2 Drawing Sheets

NOZZLE SYSTEM FOR ENGINES

BACKGROUND OF THE INVENTION

This invention relates to a new injection nozzle system and a new method for effecting an improved degree of combustion of fuel by an internal combustion engine particularly of the diesel type. An especially significant feature of the invention is that of injecting pressurized cleaning air through the injection orifice structure into the combustion chamber after the step of injecting a pressurized premixture of fuel and air through that structure.

Although the invention has primary application for diesel engine design, it may also be useful in engines where burning is initiated by a electric spark.

Some early diesel engines employed pressurized air for breaking fuel up into minute particles (frequently called atomization) at the time of injection into the combustion cylinder, but with the advance of spray nozzle designs capable of sufficiently atomizing the diesel fuel by the use of fuel pressure only, the solid or airless type of injection became the generally accepted method of fuel injection for compression-ignition engines.

Recently the intensive drive toward energy independence has led many to consider plant oils as a extender or replacement for diesel fuel. The significantly higher viscosity of plant oils in comparison to conventional diesel fuel militates against accomplishing atomization or fine particle split up under typical fuel injection conditions. The higher viscosity fuel resists movement through injection orifices into a combustion chamber. Additionally some of the higher viscosity fuel remains in the injection cavity or sac volume and in the orifices after injection using conventional techniques. The residual fuel in the cavity and the orifices thermally decomposes during the burning or power stroke of the engine and causes an excessive carbonaceous buildup in the cavity and orifices of the nozzle tip. The buildup interferes with subsequent injection steps.

Reduction or elimination of the injection cavity or sac volume of an injection nozzle has been proposed, but such a change of design seriously influences the injection phenomena causing differences in the fuel spray at each spray hole as well as at each injection into the combustion chamber.

SUMMARY OF THE INVENTION

The new nozzle system and method broadens the range and variety of burnable carbon-containing fuels which may be employed satisfactorily in diesel engines, and permits the use of even relatively viscous oils such as plant oils for diesel fuel.

Internal combustion engines contemplated by the invention have at least one combustion chamber or cylinder within which a piston reciprocates through a compression stroke followed by a power stroke in effecting rotation of a crank shaft. The relevant position of the piston during engine operation is suitably defined by crank degrees before or after Top Dead Center in the engine cylinder.

The new method involves continuously maintaining an elevated pressure in a premix chamber by supplying thereto elevated pressure air from an air reservoir through a passage equipped with an unidirectional valve. An important method step is that of closing communication from the premix chamber through an injection orifice structure into the combustion chamber of the internal combustion engine at a time when the compression pressure in the combustion chamber is below or no greater than that of the elevated pressure of the air in the premix chamber. The closure is effected quickly at some point within an overall range of about 30 crank degrees, the point being somewhere between about 20 crank degrees before Top Dead Center in the compression stroke of the piston and about 10 crank degrees after Top Dead Center in the power stroke. Promptly after closure, a measured quantity of fuel is spurted into the premix chamber. Spurting of the fuel is accomplished under a pressure in excess of the elevated pressure of the air in the premix chamber. The time of the spurting is at a point somewhere within the period of 30 crank degrees of piston movement after closure of the injection orifice structure. This early spurting of the fuel into the premix chamber during the cycle of engine operation effectively permits a lengthy period of premixing with air so as to increase the atomization or microscopic split up of the fuel. The atomization is further enhanced at the time of actual injection of the premixture into the combustion chamber of the internal combustion engine.

The injection into the combustion chamber is accomplished by opening communication from the premix chamber through the injection orifice structure to the combustion chamber at a point in time somewhere during the compression stroke of the piston. This point is no earlier than about 30 crank degrees before the injection orifice passage closure is accomplished, but is sufficiently before that closure so as to effect full discharge of the premixed air and fuel from the crank degrees before the injection orifice passage closure is accomplished, but is sufficiently before that closure so as to effect full discharge of the premixed air and fuel from the premix chamber into the combustion chamber by the elevated pressure of air from the air reservoir as well as a follow up purge of the elevated pressure air through the orifice structure so as to minimize the chances of residual fuel remaining in the orifice structure when communication through the injection orifice structure is closed.

The invention also provides an improved nozzle assembly for conducting the method. The nozzle body of the improved nozzle houses a premix chamber from which a passage extends to an injection orifice structure which is placed in communication with the combustion chamber of an internal combustion engine. A valve within the nozzle body is adapted to shut off communication from the premix chamber into the combustion chamber as well as to open that communication for an injection into the combustion chamber from the premix chamber. A fuel injector passage as well as an air inlet passage each terminate at a port into the premix chamber. An elevated pressure air reservoir is in constant communication with the air inlet passage, the later having an unidirectional valve in it to allow passage of air from the reservoir into the premix chamber at all times except when the pressure in the premix chamber exceeds the pressure of the air from the reservoir. The fuel injector valve in the fuel injector passage maintains that passage normally closed but openable when fuel is spurted into the premix chamber under a pressure in excess of the air pressure within it. A means is provided to open passage through the injection orifice structure into the combustion chamber from the premix chamber.

This means is actuated responsively to engine timing reflecting the position of the piston in the combustion chamber. The closure means for the valve is suitably provided by biasing the valve in a position to close passage through the injection orifice structure.

Advantageously the new design and method permits the retention of nozzle sac volume or cavity improvement of injection spray patterns even when viscous fuels are employed, contributes to the reduction of carbon buildup on the nozzle tip or injection orifice structure, enhances homogeneous fuel-air premixing, contributes to an improved combustion process by the injection of purging air after every fuel-air injection, contributes to a reduction of hydrocarbon exhaust emissions, and completes combustion chamber injection of the fuel-air premixture at maximum valve opening or lift, with valve closure occurring after an air purge through the injection orifice structure. Still other benefits of the invention will be evident as this description proceeds.

DESCRIPTION OF PREFERRED EMBODIMENTS

Figure 1:
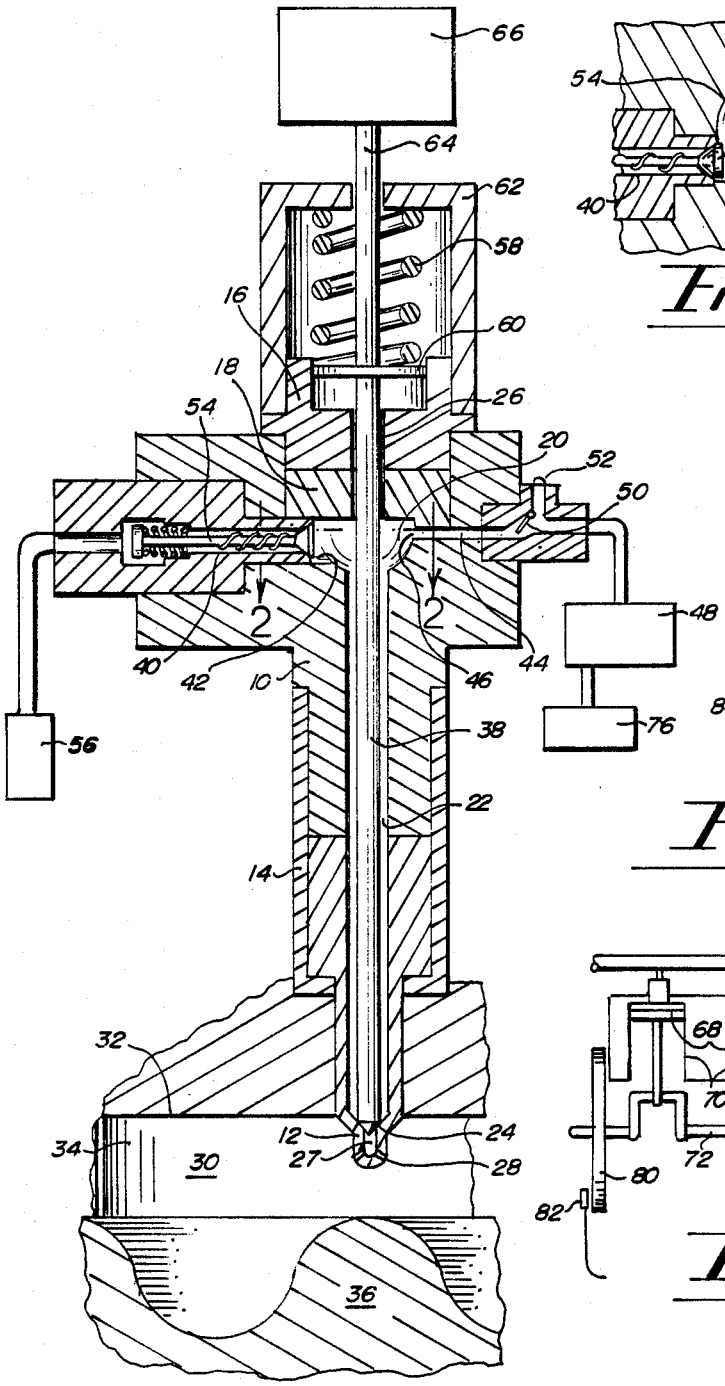
FIG. 1 is a schematic cross-sectional view of a new nozzle assembly of the invention, including immediately associated elements and with some parts broken away.

Referring particularly to FIG. 1, the improved nozzle assembly of the invention includes an elongated nozzle body made up of a group of any suitably machined parts. The illustrated body parts include a base portion 10, a nozzle tip structure 12, a cylindrical housing element 14, a plug 16 and spacer 18. These parts are assembled together using suitable seals and fastening means well known to the art.

Figure 2:
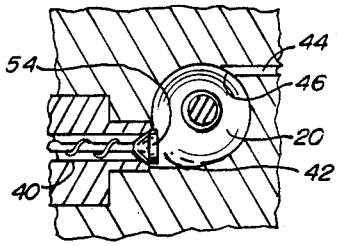
FIG. 2 is a fragmentary schematic sectional view on line 2—2 of FIG. 1, illustrating tangential inlet passages for fuel and air into the circular premixing chamber so as to effect circular motion, and also illustrating an auger-like shaft for a fuel injector valve so as to swirl the emptying fuel into the premix chamber.

The nozzle body is elongated and has intermediate its ends an axially circular premix chamber 20, as illustrated in FIGS. 1 and 2. Preferably this chamber is semispherical, as illustrated, but optionally it may be cylindrical in portions. From the premix chamber an axial passage 22 extends in one direction through the body to a valve seat 24 and an axial bore 26 extends in the opposite direction. An injection orifice structure 28 is located at the valve seat end of the axial passage 22; and the injection orifice structure suitably may be equipped not only with an injection sac volume or cavity 27 (i.e., the interior space between the tips of needle 38 and orifice passages into the combustion chamber 30), but also may be equipped with two or more orifice passages. Preferably the orifice passages are sloped radially outward from the central axis so as to carry an injection through them in a radially outward pattern which contributes to further atomization of fuel at the time of a fuel-air injection. The orifice structure 28 is in communication with the combustion chamber 30 of the engine, the chamber itself being defined by the head 32 over the cylinder, the cylinder 34 itself, as well as the location of the piston 36 within the chamber. The chamber face of the piston may be equipped with special contours as illustrated. Likewise the head 32 may be provided with special contours to enhance last minute mixing and burning.

A needle valve 38 is mounted for slidability within the axial bore 2 and engagement with the valve seat 24. The shaft of the needle valve 38 is spaced from the walls of the axial passage 22 between the premix chamber and the valve seat.

Referring now to FIGS. 1 and 2, a fuel injector passage 40 terminates at a port 42 into the premix chamber 20; and an air inlet passage 44 terminates at its port 46 into the premix chamber. These passages each are tangentially oriented to the circular premix chamber for emptying into the chamber in a common circular direction. The port 42 of the fuel injector passage 40 is circularly spaced from the port 46 of the air inlet passage 44. Indeed, as illustrated, these ports are preferably diametrically opposite each other. The most preferred premixing is accomplished when both the air and the fuel are maintained in constant movement during the premixing stage. The illustrated arrangement contributes to a circular movement throughout premixing and enhances the microscopic break up or volitalization or atomization of the fuel in the premix air.

An elevated pressure air reservoir 48 is in constant communication with the air inlet passage 44 which itself is equipped with a one way valve or check valve 50 effecting only unidirectional flow of air from the reservoir through the air inlet passage. A relief or escape valve 52 to bleed off excessive air pressures may be incorporated in the structure. Elevated pressure air passes through the inlet passage 44 at all time except when the pressure in the premix chamber exceeds the pressure of the air from the reservoir.

In the fuel injector passage 40 to the premix chamber 20 is a valve suitably termed a fuel injector valve 54. This valve or the housing for it may be equipped with some means to impart a rotary or swirling rotation to fuel injected through the fuel injector passage into the premix chamber. As illustrated, the shaft of the valve has a spiralled projection to effect swirling rotation of fuel injected into the premix chamber. The head end of the fuel injector valve maintains the fuel injector passage 40 in a normally closed condition at its port end 42. The valve is only opened to admit fuel into the premix chamber at a limited time during the sequence of operation of the complete assembly. Illustratively, the fuel injector valve 54 is biased so that its enlarged head end rests in closure upon a valve seat at the port end 42 of the passage 40. Biasing may be accomplished by any suitable means such as by the use of a spring between a passage shoulder and a flange on the shaft of the valve. To be emphasized is that the schematic showing for this valve in the drawing is done for the sake of simplicity in illustrating its performance functions. The preferred injector valve suitably is one of the conventional poppet type.

A fuel pump means 56 is provided to generate the pressure for effecting the opening of the fuel injector valve to spurt fuel into the premix chamber under a pressure in excess of the air pressure of the air in that chamber. Fuel injector pumps are well known and suitably include a plunger which thrusts on its delivery stroke to force a measured quantity of fuel through the fuel inlet line to the fuel inlet passage. Operation of the plunger thrust of fuel in the engine operation requires no explanation as it is well known as also are various means for metering the measured quantity of fuel for the plunger thrust.

The needle valve 38 of the assembly is biased to normally close passage through the injection orifice 28. Illustratively, biasing is accomplished by emphasizing a helical compression spring 58 between a flange 60 supported by a body part 16 and the bottom or internal surface portion of a nozzle cap 62. The stem 64 of a needle valve 38 extends through the cap 62 and is in association with any suitable means 66 for lifting the needle valve from its valve seat to open passage through the injection orifice structure 28 into the combustion chamber 30 as well as for causing return of the needle valve to the valve seat to close the passage through the injection orifice structure. Illustratively the means 66 for lifting the needle valve may be a solenoid. It may, however, be a cam arrangement or other mechanical arrangement. Those skilled in the art have devised a multitude of arrangements and devices for accomplishing opening and allowing closure of a valve. The important consideration in selecting the means for lifting the needle valve from its valve seat is that of effectively actuating the means responsively to the engine timing reflecting the position of the piston in the particular combustion chamber to be served by the nozzle assembly of the present invention.

Figure 3:
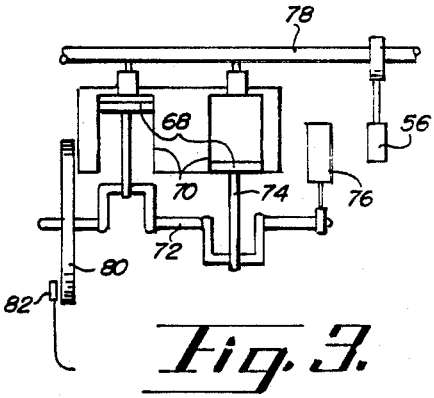
FIG. 3 is a generalized fragmentary schematic view illustrating elements such as flywheel, crankshaft and pistons of an internal combustion engine.

Referring for the moment to FIG. 3, internal combustion engines, including those of the diesel type where this invention is especially useful, most frequently are equipped with more than one piston 68 and cylinder 70 combination with the pistons connected to a crankshaft 72 by piston rods 74. The position of a piston within the cylindrical piston housing at any particular point in its cycle of operation is conventionally defined by crank degrees before or after Top Dead Center (or Bottom Dead Center for that matter).

An air compressor 76 for feeding elevated pressure air to the air reservoir 48 may be operated off the crankshaft 72 of the engine; and the fuel injector pump 56 may be operated off the cam shaft 78 of the engine. Illustrated in FIG. 3 also is a flywheel 80 mounted on the crankshaft 72 and a single Hall Effect switch 82 in proximity to the flywheel.

Figure 4:
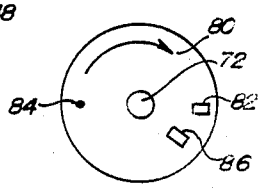
FIG. 4 is a schematic plan view of a flywheel carrying a permanent magnet and associated Hall Effect switches.

In FIG. 4, a schematic illustration of the flywheel 80 carries on it a permanent magnet 84. Also there shown is Hall Effect switch 82 as well as an additional Hall Effect switch 86, each positioned for triggering as a magnet passes in their sensed field.

Figure 5:
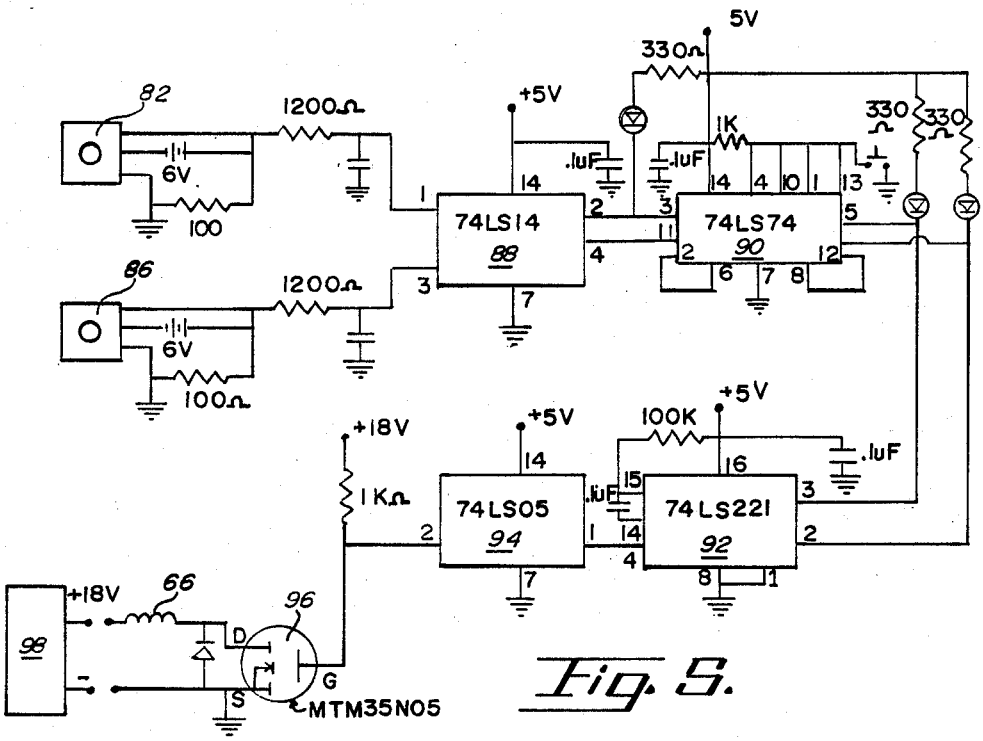
FIG. 5 is an illustrative diagramatic circuitry for effecting solenoid opening and closure of the injection orifice structure emptying into the combustion cylinder of an engine.

The electrical circuit of FIG. 5 is but one means for actuating the needle valve lift from its valve seat 24 to open passage from the premix chamber 20 through the injection orifice structure 28 into the combustion chamber 30 of an engine. The first element operating in this illustrative injection timing circuit is the Start Hall Effect switch 82 which is triggered as the magnetic flux of a permanent magnet (e.g. magnet 84 on flywheel 80) passes it. The triggered switch sends a pulse through one line to the dual Schmidt Trigger 88 which converts the pulse to a square wave. The square wave enters the dual clock 90 which in combination with timer 92 functions as a "divide by two" counter converting two input "Start" pulse waves into a single output. (This illustrates the operation desired for a four stroke cycle operation since the magnet for the "Start" Hall Effect switch passes that switch twice during one complete cycle of operation in a four stroke cycle. In the case of a two stroke cycle operation, the clock's only function would be that of providing an output per input.) Output from the dual clock 90 becomes input for the timer 92 which inverts the signal and sends it to the invertor 94 and thence to the actuator switch 96 (e.g. a metal oxide field effect transistor) which passes power from a power source 98 to the solenoid 66. The duration of the output pulse from the timer 92 is controlled by the second Hall Effect switch 86 which serves as a "Stop" switch, terminating power actuation of the solenoid and thereby releasing the needle valve to slide back into its seat an effect closure of the passage through the injection orifice structure 28. Circuitry for effecting opening and closure of a valve in timed relationship for engine operation under a variety of load and speed condition is well known. (The illustrated circuitry of FIG. 5 employs chips from Texas Instruments, Inc. of Dallas, Tex.; and the chip numbers and terminals and other valves are set forth in the Figure.) It is the application of known circuitry to effect the sequence of operation of the method of this invention that is new.

Figure 6:
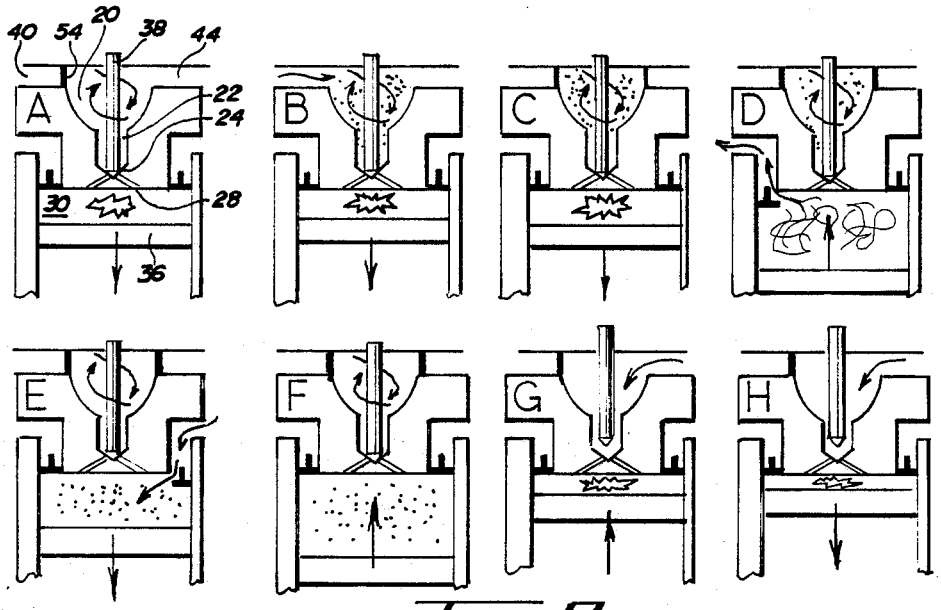
FIG. 6 is a series of schematic vignettes illustrating relationships between elements of the new nozzle assembly over a four stroke piston cycle of operation.

The method of engine operation according t this invention is schematically illustrated for a four stroke cycle engine operation in vignettes A through H of FIG. 6. The views of the vignettes are quite graphic; and for the sake of simplicity only the first, namely vignette A, will be labelled with numbers for its parts. The numbers used are those for the same parts as labeled in FIG. 1. The first vignette, labelled A, illustrates the condition of the fuel 40 and air inlets 44 to the premix chamber 20 as well as the needle valve 38 position and relative position of the piston 36 in the combustion chamber 30 at the moment of return of the needle valve 38 to its valve seat 24 following an injection into the combustion chamber 30. At that moment when the needle valve 38 hits its seat 24 to effect closing of the orifices 28 and termination of injection into the combustion chamber, the unidirectional valve (not shown in vignette A) of the air inlet 44 is open (i.e., air passage 44 to premix chamber 20 is open). Further, at that moment, the fuel inlet valve 54 to the premix chamber 20 is closed or only beginning to open. Combustion is occurring within the combustion chamber 30, thereby greatly increasing the pressure within it; and the piston 36 is descending.

Vignette B illustrates the next moment where all conditions as in vignette A are the same except that the fuel valve is open and introducing fuel into the premix chamber. That introduction of fuel into the premix chamber occurs under a pressure condition in excess of the elevated pressure of the air in the premix chamber from the air reservoir, and thus the fuel addition tends to ultimately cause closure of the valve in the air inlet passage. It is not necessary that full closure of the air inlet passage by the directional valve occur. The pressure increase effected by the injection of fuel is relatively modest and even may in some instances have little or no effect to cause closure of the unidirectional valve. That air valve closure is mainly the result of pressure equilization. When the pressure within the premix chamber is equal to the pressure of the incoming air line, the unidirectional valve (biased as it is) will close.

Then in vignette C, combustion continues forcing the piston downwardly; and closure of the fuel passage to the premix chamber has occurred promptly after the spurt injection of fuel. Stabilization or equalization of premix chamber pressure and incoming air pressure from the reservoir (with the orifice passage closed) will allow closure of the unidirectional valve of the air inlet.

The exhaust stroke of vignette D finds all three valves closed (fuel, air, and injection orifice), with the fuel and air in the premix chamber swirling and intermixing.

The combustion chamber air intake stroke of vignette E similarly illustrates the continued intermixing of the fuel and air in the premix chamber. The fuel valve, air valve and orifice valve are all closed. Those three valves remain closed at the beginning of the compression piston stroke illustrated in vignette F.

In vignette G, as the compression stroke continues, but before Top Dead Center, the needle valve is lifted from its valve seat to allow injection of the premixed fuel and air into the combustion chamber above the piston. Movement of that premixture into the combustion chamber is forced by the incoming air from the air reservoir. That air is under elevated pressure in excess of that prevailing in the compression stroke at the point in time that the needle valve is lifted from its valve seat.

The purpose of vignette H is to illustrate that the elevated pressure from the air reservoir continues air flow through the premix chamber and the axial passageway out the injection orifice structure after the fuel-air premixture has been injected in the combustion chamber. This additional air purge through the injection orifice structure cleans the residual fuel from the sac cavity and injection orifices or ports to a significant extent; and at least minimizes the presence of any residual fuel in the sac cavity and injection orifices of the composite injection orifice structure before the actual step of closure of passage through the injection orifice structure.

Engine timing of course does affect the precise moment of needle valve lift as well as return to its seat and also the exact moment of the spurt of fuel into the premix chamber.

The closure or termination or passage through the injection orifice structure is effected within a range of crank angle degrees, namely a range of about 30 crank angle degrees. The actual specific moment of closure is at a point somewhere between 20 crank degrees before top dead center in the compression stroke and 10 crank degrees after top dead center in the power stroke of the piston and while the pressure in the combustion chamber is below that of the air pressure of the air in that passage.

Opening of the injection orifice structure is at a point during the compression stroke no earlier than about 30 crank degrees before the moment of closure effected for the injection orifice structure. This opening of the passage through the injection orifice structure is sufficiently before the closure so as to effect full discharge of premixed air and fuel from the premix chamber into the combustion chamber by the air from the elevated air pressure reservoir as well as a further follow up of air through the orifice structure to blow out from the orifices thereof an residual fuel before closure of passage through the injection orifice structure is accomplished. Injection into the combustion chamber is always accomplished without closing the air inlet into the premix chamber.

A significant feature of the invention is the extensive time of premixing of the fuel with the air in the premix chamber before that premixture is actually injected into a cylinder for combustion. The fuel pump is actuated in timed relationship to the injection orifice structure closure; and the fuel pump timing from the cam shaft is such that the pump is actuated to spurt fuel into the premix chamber sometime within the period of about 30 crank degrees after closure of the needle valve over the injection orifice structure.

Diesel engine operation according to the teaching of the invention has been accomplished with notable success. Experiments have been conducted using an 800 pounds per square inch air pressure for the air reservoir. The compression pressure generated by the compression stroke of diesel engines is a variable; but medium sized diesel engines generally will generate a maximum compression pressure in the range of about 600 psi. Elevated air pressures in excess of the compression pressures or at least in excess of the particular compression pressure in a diesel cylinder at the crank angle degree moment of closure of the needle valve of the nozzle assembly are useful. The elevated pressure of 800 psi is but illustrative. In a diesel operated for a 100 percent power curve at 2300 rpm and 75 Horsepower, the needle valve opened at 17 degrees before Top Dead Center, closed at 8 degrees after Top Dead Center, and the firing pressure maximum was at about 1800 psi. For 100 percent power curve at 1800 rpm and 100 Horsepower the needle opened at 20 degrees before Top Dead Center and closed at Top Dead Center with a firing pressure maximum at about 1800 psi. For a 25 percent power curve at 2300 rpm and 19 Horsepower, needle opening was at 8 degrees before Top Dead Center and closure at 4 degrees after Top Dead Center, with a firing pressure maximum at about 800 psi. At 1800 rpm and 25 Horsepower for 25 percent power curve, needle opening was at 10 degrees before Top Dead Center and closure at 1 degree before Top Dead Center, with a maximum firing pressure of about 800 psi. Opening and closure times thus vary according to different loads as well as engine revolution speed. Open and closure times may be different also when higher air pressure is maintained in a reservoir. If lower air pressures are employed in an air reservoir (e.g. as low as 400 or 500 psi) earlier closure of the needle valve on its seat over the injection orifice structure will be necessary, even an earlier closure as much as 10 degrees or so before Top Dead Center so as to effect closure before pressure within the compression stroke exceeds the pressure of the air push from the air reservoir.

Engine start up is suitably accomplished by using auxiliary power, as common for pre-existing systems.

A factor to recognize is that while the act of compressing air greatly increases the temperature of the air and is a fundamental principle on which diesel ignition is based, an elevated temperature is not an inherent condition for compressed air. The heat dissipates with time and an air passage from a reservoir may be equipped with cooling fins to effect a sufficient reduction of the temperature for the elevated pressure air so that it is below the diesel ignition temperature of the particular fuel employed to avoid fuel ignition within the premix chamber. Diesel ignition temperatures vary depending on the fuel, but generally temperatures in excess of about 700° F. are almost always required; and those diesel ignition temperatures are avoided at the premix stage.

The invention may be embodied in other specific forms than illustrated without departing from the spirit or essential characteristics thereof; and equivalent gases may replace air. The illustrated embodiment is therefore to be considered in all respects as illustrative and not restrictive, the scope of the invention being indicated by the appended claims rather than by the foregoing description; and all changes which come within the meaning and range of equivalency of the claims are therefore intended to be embraced thereby.

That which is claimed is:

1. A method for effecting an improved degree of combustion of fuel and for reducing unwanted carbon buildup in an injection orifice structure feeding a combustion chamber of an internal combustion engine having at least one such combustion chamber within which a piston reciprocates through a compression stroke followed by a power stroke, said method comprising:

a. continuosuly maintaining an elevated pressure in a premix chamber by supplying thereto elevated pressure air from an air reservoir through a passage equipped with an unidirectional valve, b. closing an open communication from the premix chamber through the injection orifice structure to the combustion chamber of the internal combustion engine, said injection orifice structure closure being effected at the time when the pressure in the combustion chamber is below that of the elevated pressure of the air in the premix chamber, c. spurting into the premix chamber, momentarily after said injection orifice structure closure, a measured quantity of fuel under a pressure in excess of the elevated pressure of the air in said premix chamber, and d. opening communication from the premix chamber through the injection orifice structure to the combustion chamber at a time during the compression stroke of the piston and sufficiently before said injection orifice structure closure to effect full discharge of premixed air and fuel from the premix chamber into the combustion chamber by said elevated air pressure air form the air reservoir as well as a follow up air purge by said elevated pressure air through the orifice structure to minimize residual fuel in said orifice structure before said injection orifice structure closure.

2. The method of claim 1 additionally including the step of diesel ignition of the fuel-air mixture within the combustion chamber.

3. The method of claim 1 wherein the fuel spurted into the premix chamber comprises a viscous burnable fuel other than a petroleum based fuel, said method additionally including the step of diesel ignition of the fuel-air mixture within the combustion chamber.

4. A method for effecting an improved degree of combustion of fuel and for reducing unwanted carbon buildup in an injection orifice structure feeding a combustion chamber of an internal combustion engine having at least one such combustion chamber within which a piston reciprocates through a compression stroke followed by a power stroke, the position of the piston being defined by crank degrees before or after Top Dead Center, said method comprising:

a. continuously maintaining an elevated pressure in a premix chamber by supplying thereto elevated pressure air from an air reservoir through a passage equipped with an unidirectional valve, b. closing an open communication from the premix chamber through the injection orifice structure to the combustion chamber of the internal combustion engine, said injection orifice structure closure being effected within the range of 30 crank degrees at a point somewhere between 20 crank degrees before Top Dead Center in the compression stroke and 10 crank degrees after Top Dead Center in the power stroke and while the pressure in the combustion chamber is below that of the elevated pressure of the air in the premix chamber, c. spurting into the premix chamber, momentarily after said injection orifice structure closure, a measured quantity of fuel under a pressure in excess of the elevated pressure of the air in said premix chamber, said spurt of fuel into said premix chamber being accomplished sometime within the period of 30 crank degrees after said injection orifice structure closure, and d. opening communication from the premix chamber through the injection orifice structure to the combustion chamber at a time during the compression stroke of the piston no earlier than about 30 crank degrees before said injection orifice passage closure but sufficiently before said injection orifice structure closure to effect full discharge of premixed air and fuel from the premix chamber into the combustion chamber by said elevated air pressure air from the air reservoir as well as a follow up air purge by said elevated pressure air through the orifice structure to minimize residual fuel in said orifice structure before said injection orifice structure closure.

5. The method of claim 4 step of diesel ignition of the fuel-air mixture within the combustion chamber.

6. The method of claim 4 wherein the fuel spurted into the premix chamber comprises a viscous burnable fuel other than a petroleum based fuel, said method additionally including the step of diesel ignition of the fuel-air mixture within the combustion chamber.

7. An assembly for injecting a fuel-air premixture followed by purging air through an injection orifice structure into the combustion chamber of an internal combustion engine, said assembly comprising:

a nozzle body having a premix chamber and an injection orifice structure separated by a valve means normally closing communication from said premix chamber through said injection orifice structure, a fuel injector passage and an air inlet passage into said premix chamber, an elevated pressure air reservoir in constant communication with the air inlet passage, an unidirectional valve in the air inlet passage to allow passage of air from the reservoir through said air inlet passage into said premix chamber at all times except when the pressure in the premix chamber exceeds the pressure of the air from the reservoir, there being no other means for stopping air from said reservoir from entering said premix chamber, a fuel injector means in said fuel injector passage maintaining said fuel injector passage normally closed, said fuel injector means being actuatable for spurting fuel into said premix chamber under conditions of fuel pressure in excess of the air pressure in said premix chamber, and means for shifting said valve means to open passage from said premix chamber through said injection orifice structure for injection of a premixture of fuel and air from said premix chamber through said injection orifice structure under the pressure of air from said air reservoir followed by injection of air from said reservoir through said injection orifice structure to minimize residual fuel in said orifice structure before said valve means is closed.

8. The assembly of claim 7 wherein the premix chamber is circular in design and the fuel injector passage and air inlet passage are tangentially oriented to the circular premix chamber for emptying into the chamber in a common circular direction.

9. The assembly of claim 7 wherein the injection orifice structure comprises an injection cavity and more than one orifice passage from said injection cavity.

10. In an internal combustion engine having at least one combustion chamber within which a piston reciprocates through a compression stroke followed by a power stroke, the position of the piston being defined by crank degrees before or after Top Dead Center, the improvement comprising an assembly for injecting a fuel-air premixture followed by purging air through an injection orifice structure into the combustion chamber, including:

an elongated nozzle body having intermediate its ends an axially circular premix chamber from which an axial passage extends in one direction to a valve seat and an axial bore extends in the opposite direction, an injection orifice structure at the valve seat end of said axial passage, said injection orifice structure being in communication with the combustion chamber, a needle valve slidable within the axial bore and engageable with the valve seat, the shaft of the needle valve being spaced from the walls of the axial passage between the premix chamber and the valve seat, a fuel injector passage terminating at a port into said premix chamber and an air inlet passage terminating at a port into said premix chamber, an elevated pressure air reservoir in constant communication with the air inlet passage, an unidirectional valve in the air inlet passage to allow passage of air from the reservoir through said air inlet passage into said premix chamber at all times except when the pressure in the premix chamber exceeds the pressure of the air from the reservoir, a fuel injector valve in said fuel injector passage to maintain said fuel injector passage normally closed, fuel injector pump means for opening said fuel injector valve to spurt fuel into said premix chamber under pressure in excess of the air pressure in said premix chamber, means biasing the said needle valve in engagement with said valve seat to close passage through said injection orifice structure, and means actuated responsively to engine timing reflecting the position of the piston in the combustion chamber for lifting said needle valve from said valve seat to open passages from said premix chamber through said injection orifice structure into the combustion chamber for injection of premixed air and fuel through said orifice structure under the pressure of the air from said air reservoir followed by injection of air from said reservoir through said injection orifice structure to minimize residual fuel in said orifice structure before return of said needle valve to its valve seat, said injection orifice structure closure being effected within the range of 30 crank degrees at a point somewhere between 20 crank degrees before Top Dead Center in the compression stroke and 10 crank degrees after Top Dead Center in the power stroke of the piston and while the pressure in the combustion chamber is below that of the air pressure in the premix chamber.

11. The assembly of claim 10 wherein said fuel injector passage and air inlet passage each are tangentially oriented to said circular premix chamber for emptying into the chamber in a common circular direction.

12. The assembly of claim 11 wherein the port for the fuel injector passage into the premix chamber is circularly spaced from the port for the air inlet passage.

13. The assembly of claim 11 wherein the port for the fuel injector passage into the premix chamber is diametrically opposite the port for the air inlet passage.

14. The assembly for claim 10 wherein the injection orifice structure comprises injection cavity and more than one orifice passage from said injection cavity.

15. The assembly of claim 10 wherein the opening of said injection orifice structure is effected during the compression stroke and no earlier than about 30 crank degrees before the injection orifice structure closure but sufficiently before said closure to effect full discharge of the premixed air and fuel from the premix chamber into the combustion chamber by air from the air reservoir as well as the follow up air purge through the orifice structure to minimize residual fuel in said orifice structure before said injection orifice structure closure, and timed means actuating said fuel pump for momentary spurt of fuel into said premix chamber sometime within the period of 30 crank degrees after said injection orifice structure closure to thereby initiate premixing and atomization of fuel in air for the next fuel-air injection into the combustion chamber promptly following each said injection orifice structure closure.

* * * * *